US007589475B2

(12) United States Patent
Petzl et al.

(10) Patent No.: US 7,589,475 B2
(45) Date of Patent: Sep. 15, 2009

(54) ELECTRIC LAMP WITH ENHANCED DEPENDABILITY

(75) Inventors: Paul Petzl, Barraux (FR); Omar Bouzghoub, Domene (FR); Gilles Morey, Saint-Ismier (FR)

(73) Assignee: Zedel, Crolles (FR)

( * ) Notice: Subject to any disclaimer, the term of this patent is extended or adjusted under 35 U.S.C. 154(b) by 136 days.

(21) Appl. No.: 11/808,709

(22) Filed: Jun. 12, 2007

(65) Prior Publication Data

US 2007/0290631 A1 Dec. 20, 2007

Related U.S. Application Data

(60) Provisional application No. 60/814,898, filed on Jun. 20, 2006.

(30) Foreign Application Priority Data

Jul. 28, 2006 (FR) ..... 06 06943

(51) Int. Cl.
*H05B 37/02* (2006.01)

(52) U.S. Cl. ..... 315/209 R; 315/224; 315/225; 315/226

(58) Field of Classification Search ..... 315/209 R, 315/224–226

See application file for complete search history.

(56) References Cited

U.S. PATENT DOCUMENTS

| | | | | |
|---|---|---|---|---|
| 4,456,855 | A * | 6/1984 | Sairanen | 315/308 |
| 5,030,890 | A | 7/1991 | Johnson | |
| 6,140,776 | A | 10/2000 | Rachwal | |
| 6,249,089 | B1 | 6/2001 | Bruwer | |
| 2002/0109465 | A1 | 8/2002 | Miyoshi | |

FOREIGN PATENT DOCUMENTS

| | | |
|---|---|---|
| DE | 296 00 938 U1 | 4/1996 |
| FR | 2 774 528 A1 | 8/1999 |

OTHER PUBLICATIONS

Brochure for Tikka Plus©, manufactured by Petzl Corporation, Jun. 25, 2004.

* cited by examiner

*Primary Examiner*—Douglas W Owens
*Assistant Examiner*—Jianzi Chen
(74) *Attorney, Agent, or Firm*—Oliff & Berridge, PLC

(57) ABSTRACT

The lamp comprises at least one light-emitting diode and an electronic power switch connected in series between a power source and the light-emitting diode. The electronic power switch is controlled by an electronic processing circuit according to the state of a control button connected to a control input of the electronic processing circuit. The button is connected in parallel to the electronic power switch. To detect and reconstitute the state of the button, the electronic processing circuit periodically applies fine turn-off pulses to a control electrode of the electronic power switch.

8 Claims, 4 Drawing Sheets

ELECTRIC LAMP WITH ENHANCED DEPENDABILITY

This nonprovisional application claims the benefit of U.S. Provisional Application No. 60/814,898, filed Jun. 20, 2006.

BACKGROUND OF THE INVENTION

The invention relates to an electric lamp comprising at least one light-emitting diode and an electronic power switch connected in series between a power source and the light-emitting diode and controlled by an electronic processing circuit according to the state of a control switch connected to a control input of the electronic processing circuit.

STATE OF THE ART

As represented in FIG. 1, a control switch 1 is conventionally connected between a power source, for example a battery 2, and a lamp L, to control switch-on and switch-off of the lamp.

To enable different operating modes of a lamp, an electronic processing circuit, also supplied by the battery 2 and comprising a control input, can control an electronic power switch.

Thus, German utility model DE29600938U describes a lamp, more particularly a bicycle lamp, which is able to light with different intensities. As represented in FIG. 2, in this document a control switch constituted by a control button T is connected between the supply voltage Vb and the control input E1 of the electronic processing circuit 3. The latter comprises three distinct outputs connected by means of three corresponding resistors to a control electrode of a transistor T1 forming the electronic power switch. The power level (50%, 75% or 100%) supplied to the lamp L is determined according to how long the button T is kept depressed, by choosing the output activated by the electronic processing circuit 3. Signalling diodes D connected to further outputs of the electronic processing circuit 3 can indicate the power level of the lamp and/or indicate an insufficient battery charge level.

U.S. Pat. No. 6,017,140 also describes a multifunctional bicycle lamp controlled by a control button. In this embodiment, illustrated in FIG. 3, the electronic processing circuit 3 is formed by a microprocessor (μP) and the control electrode of transistor T1 is connected to a single output S1 of the electronic processing circuit. The control input E1 is directly connected to the power supply (Vb). The button T is for its part connected, in parallel with a diode, between the control input E1 and ground. Further outputs, S2 to S4, of the electronic processing circuit are connected to light-emitting diodes. The choice of operating mode is made sequentially according to the number of presses made on the button T: maximum power Pmax on the $1^{st}$ press, distress lighting mode (flashing of the diode connected to the output S2 or continuous lighting of the diode connected to the output S3) on the $2^{nd}$ press, maximum power Pmax and distress lighting at the same time on the $3^{rd}$ press, half-power (Pmax/2) on the $4^{th}$ press and switch-off on the $5^{th}$ press. The output S4 enables the state of charge of the battery to be indicated.

In a more general manner, the U.S. Pat. No. 6,249,089 describes control of various operating modes of a lamp under the control of a button T constituting the only interface with the user and located outside the power circuit connecting the battery to the lamp. The various operating modes can depend on the number of presses on the button, on the time interval between two presses and/or on how long the button is pressed.

A head-mounted lamp with light-emitting diodes marketed by the Petzl Corporation under the trade-mark Tikka Plus® is schematically illustrated in FIG. 4. Like the previous lamps, this lamp comprises a control button T between the voltage Vb of the battery and the input E1 of the processing circuit 3 and the output S1 of the processing circuit controls the power transistor T1. The processing circuit comprises two power supply terminals respectively connected to the voltage Vb of the battery 2 and to ground. The various operating modes are controlled according to the number of presses on the button and/or how long the button is pressed and/or the time interval between 2 presses.

In all the above-mentioned embodiments enabling multifunctional operation, any malfunctioning of an electronic component makes the lamp totally unusable.

OBJECT OF THE INVENTION

The object of the invention is to provide a multifunction lamp not presenting the drawbacks of known lamps.

The device according to the invention is characterized in that the control switch is connected in parallel to the electronic power switch and in that the electronic processing circuit comprises state of the control switch detecting means periodically applying fine turn-off pulses to a control electrode of the electronic power switch.

BRIEF DESCRIPTION OF THE DRAWINGS

Other advantages and features will become more clearly apparent from the following description of particular embodiments of the invention given for non-restrictive example purposes only and represented in the accompanying drawings, in which.

DESCRIPTION OF A PREFERRED EMBODIMENT OF THE INVENTION

Figure 1:
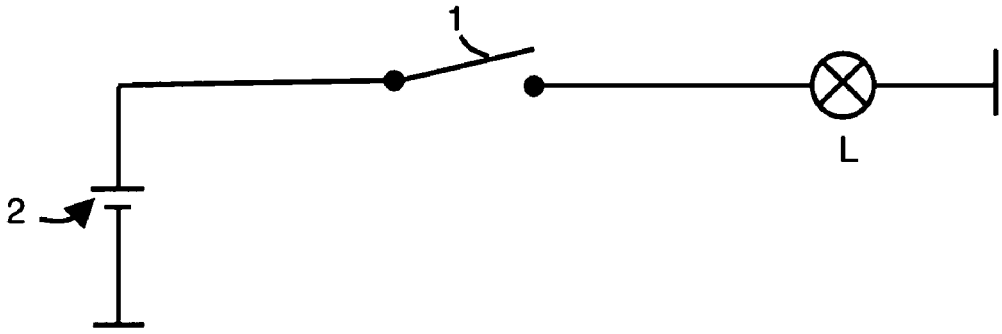
Figure 1 (prior art)
FIG. 1 represents a lamp according to the prior art.
Figure 2:
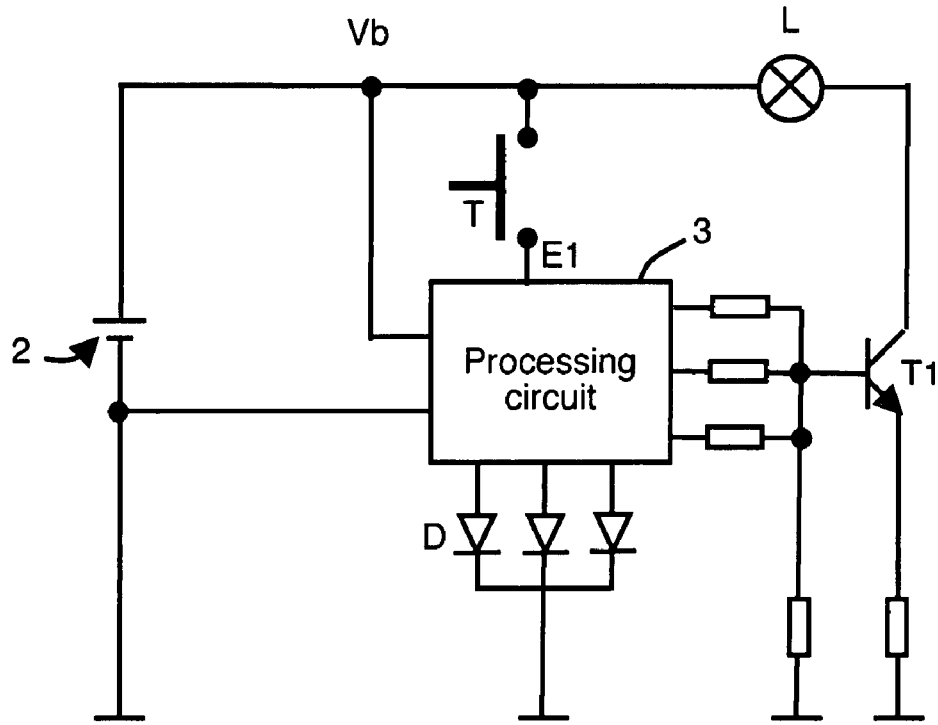
Figure 2 (prior art)
FIGS. 2 to 4 illustrate various embodiments of multifunctional lamps according to the prior art.
Figure 3:
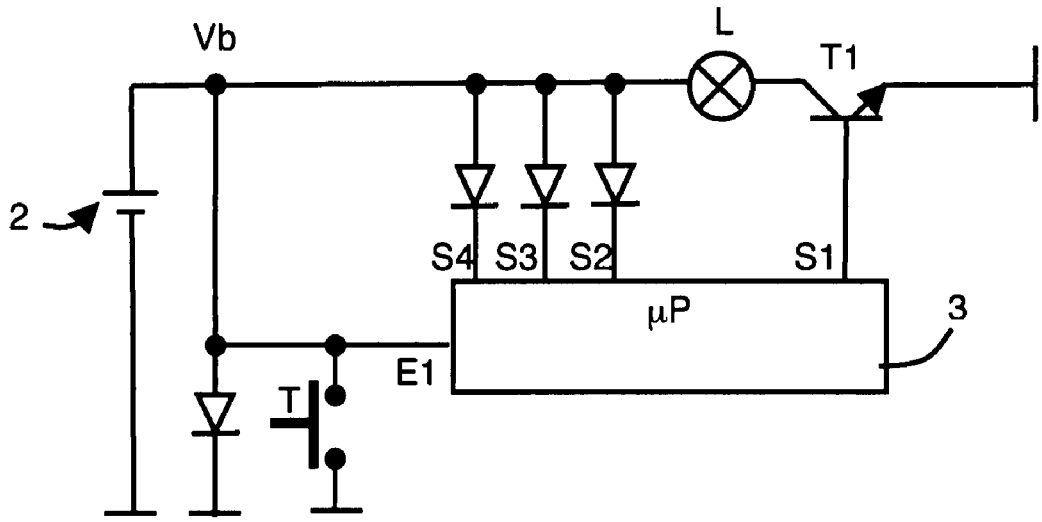
Figure 3 (prior art)
Figure 4:
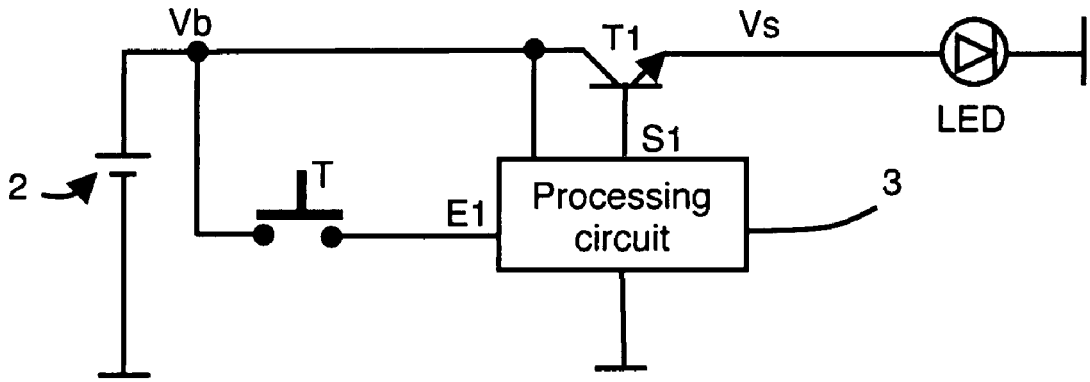
Figure 4 (prior art)
Figure 5:
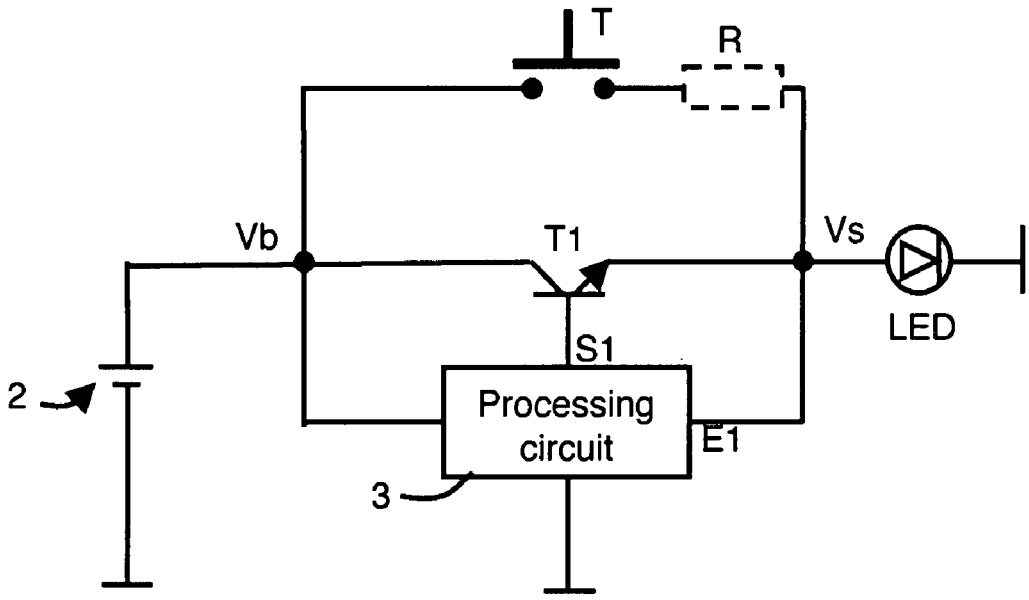
FIGS. 5 and 6 illustrate two alternative embodiments of a lamp according to the invention.

As represented in FIG. 5, the control button T is connected in parallel to the power transistor T1, which is, as in FIG. 4, connected in series between the battery 2 and at least one light-emitting diode (LED) and controlled by the signals A2 supplied by the output S1 of the processing circuit 3. The processing circuit is supplied by battery 2, as in FIG. 4.

Input E1 of the processing 3 circuit is then connected to the point which is common to the power transistor T1, to the control button T and to the light-emitting diode (LED). The signals applied to the input E1 therefore correspond to the output voltage Vs of the power transistor T1.

In this embodiment, the power switch, connected in series with the light-emitting diode (LED) to the terminals of the battery 2, thus comprises 2 branches in parallel:

- a 1st branch formed by the control button T, which is normally open,
- a 2nd branch formed by the transistor T1, controlled by the electronic processing circuit 3.

When the 1st branch is closed, i.e. during a press on the button, the voltage Vs remains constantly equal to the voltage Vb of the battery, whatever the state of the power transistor. When the 1st branch is open, the voltage Vs is controlled by the processing circuit 3 via the power transistor T1.

The electronic processing circuit 3 further comprises means for detecting and reconstituting the state of the control button T. Indeed, although the input E1 is connected to the battery 2 by means of the control button T, parallel connection of the control button T and the power transistor T1 does not enable the electronic processing circuit 3 to read the state of the button directly when the power transistor T1 is on. To enable the electronic processing circuit to detect and reconstitute the state of the control button T to control the power transistor accordingly, the electronic processing circuit 3 periodically applies fine pulses to the control electrode of the power transistor T1 switching the power transistor T1 off and monitors the voltage Vs at the terminals of the light-emitting diode.

The power transistor T1 and the processing circuit 3 are preferably formed by distinct components, as in FIG. 5. They can also be integrated in a common electronic chip. In the alternative embodiment illustrated in FIG. 6, the electronic chip 4 comprises 3 terminals only. Two power supply terminals are respectively connected to the voltage Vb of battery 2 and to ground and one input/output terminal is connected to the button T and to the lamp (LED). The button T is connected between the power supply terminal connected to the voltage Vb and the input/output terminal. The connections between the power transistor and the electronic processing circuit are made inside the chip 4.

Figure 6:
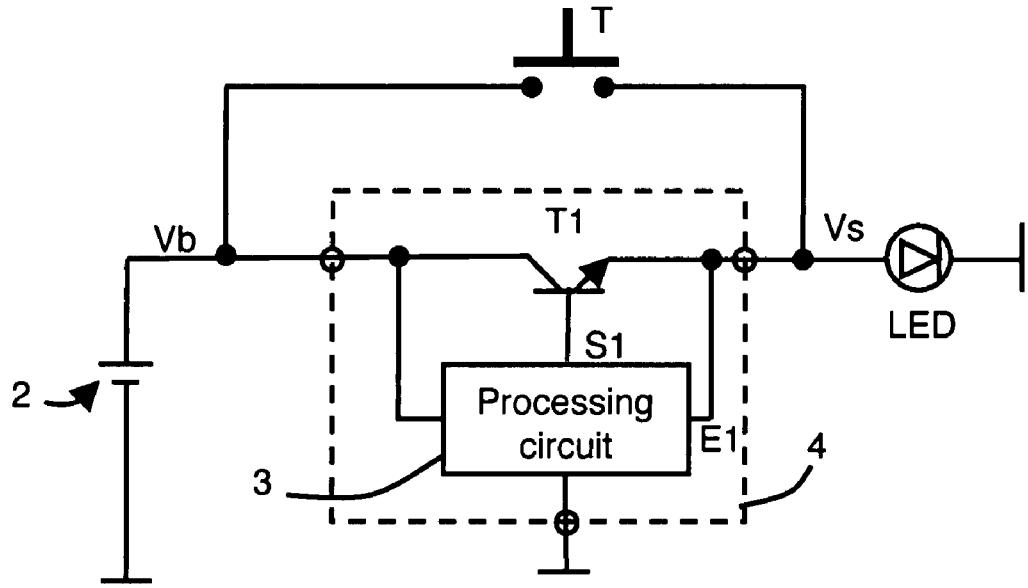

Operation of the lamp according to FIGS. 5 and 6 is described below with reference to FIGS. 7 to 10. These figures enable operation of a prior art lamp according to FIG. 4 and of a lamp according to FIG. 5 or 6 to be compared for the same states (A1) of the button T and the same successive lighting modes.

Figure 7:
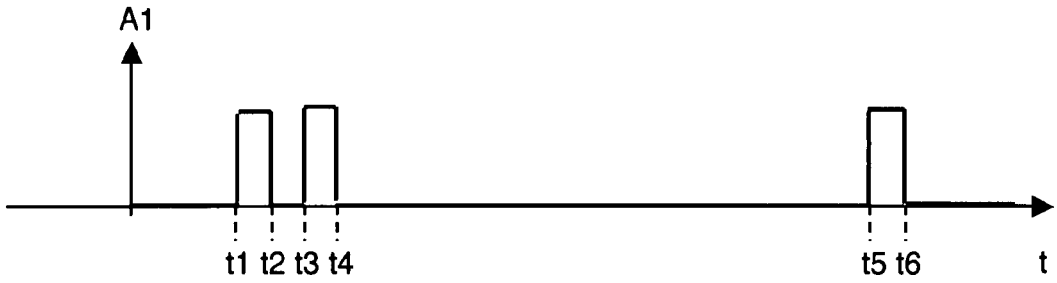
FIGS. 7 to 10 illustrate for a same state A1 of the control button T (FIG. 7) the corresponding values of the output voltage Vs of the power transistor T1 in a prior art lamp according to FIG. 4 (FIG. 8), the signals A2 supplied by the output S1 (FIG. 9) and the corresponding values of the voltage Vs in a lamp according to the invention (FIG. 10).
Figure 8:
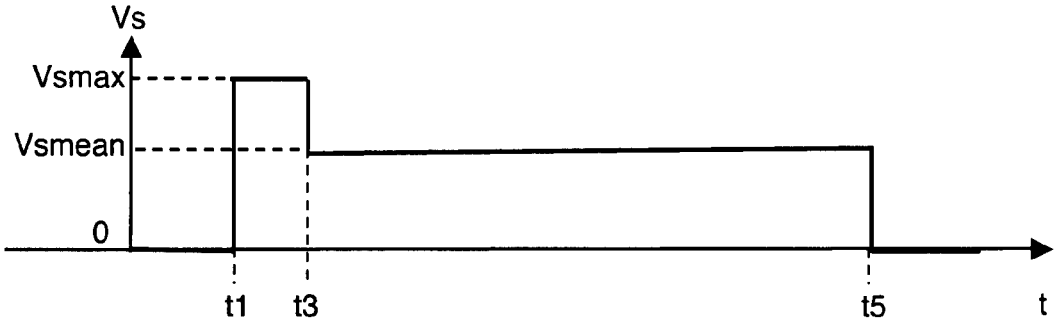
Figure 8 (prior art)

In the example represented in FIG. 7, the lamp being initially off, control of the lamp is performed by two successive presses respectively between times t1 and t2 and between times t3 and t4, then, after a time interval of more than 2 s, by pressing the button T again, between times t5 and t6. The control button T, which is normally open, is therefore only closed between the times t1 and t2, t3 and t4, t5 and t6.

In the prior art lamp according to FIG. 4, the signals A1 of FIG. 7, representative of the state of the control button T, correspond to the signals applied to the input E1 of the processing circuit 3. The electronic processing circuit then supplies controls signals of the power transistor T1 on its output S1 successively causing, in the example illustrated in FIG. 8 which represents the output voltage Vs of the power transistor T1, i.e. the voltage at the terminals of the lamp:

- as soon as the 1$^{st}$ press is made, i.e. from time t1, lighting of the lamp at a maximum lighting level in which the voltage Vs and power are maximum (Vsmax and Pmax),
- after two successive short presses, i.e. from time t3, switching to an optimum lighting level in which the voltage Vs and the corresponding power decrease (Vsmean and Pmean),
- switching-off of the lamp (Vs=0) when the button is pressed again after a time interval (t4-t5) of more than 2 s, i.e. at time t5.

In the lamp according to FIG. 5 or 6, the processing circuit modifies the signals A2 applied by its output S1 to the control electrode of the power transistor T1, so as to periodically apply fine turn-off pulses thereto. When the 1$^{st}$ press is made on the button T, at time t1, the light-emitting diode (LED) and the processing circuit input E1 are directly connected to the battery by the 1$^{st}$ branch of the switch. The signal Vs, initially at zero, then switches to the voltage Vsmax=Vb. As previously, the lamp thus lights at its maximum lighting level when the 1$^{st}$ press is made on the button. The processing circuit 3, in response to the passage to Vb of the voltage applied to its input E1, then makes the signal A2, which is initially at zero, go to a maximum value A2 max so as to close the 2$^{nd}$ branch of the switch.

The processing circuit 3 then periodically sets the signal A2 to zero during very short times, for example 1 ms every 100 ms. This periodically causes turn-off of the power transistor T1. However, although the 2$^{nd}$ branch (T1) of the power switch is then periodically open, so long as the control button T remains closed (between times t1 and t2), the 1$^{st}$ branch (T) of the power switch remains constantly closed and the voltage Vs remains at its maximum value Vsmax=Vb. The light-emitting diode (LED) is in fact directly connected by the button T to the battery. The signal Vs therefore remains unchanged (at Vsmax) until the control button T is released by the user, at time t2.

At time t2, the 1$^{st}$ branch of the switch opens, but the voltage Vs, which henceforth only depends on the state of the power transistor T1, remains at Vsmax, according to the value of the voltage A2 which has been applied thereto since time t1. However, the voltage Vs then periodically drops to zero, thus causing microbreaks, when fine turn-off pulses are applied to its control electrode. The duration of the fine pulses is chosen such that the periodic microbreaks of the lamp, caused by these fine pulses resetting the voltage Vs to zero and corresponding to simultaneous opening of the two branches of the power switch, are not perceptible to the eye of the user.

When the button T is pressed again, at time t3, the power transistor T1 is again short-circuited by the button T and the fine turn-off pulses are no longer transmitted to the voltage Vs, which remains unchanged.

Before release of the button T at time t4, the processing circuit 3 has however detected the state (A1) of the control button T from the signals Vs applied to its input E1. When the voltage Vs is not zero, the presence of fine resetting pulses or microbreaks in the signal Vs in fact means that the button T is open. The absence of pulses during a longer time than the interval between two fine turn-off pulses means on the other hand that the button T is closed and short-circuits the power transistor T1. The processing circuit can thus reconstitute the signals illustrated in FIG. 7 and use these reconstituted signals to control the power transistor T1.

Figure 9:
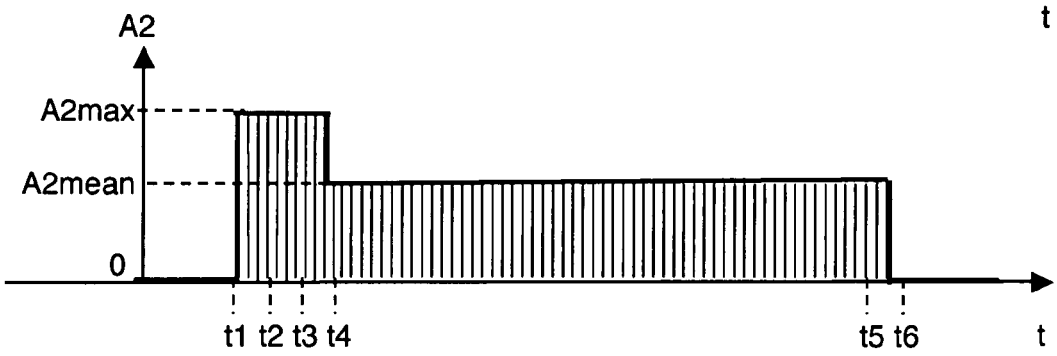

In the example represented in FIG. 9, the processing circuit makes the control signal A2 of the power transistor T1 switch to its mean value A2 mean between the times t3 and t4, after a 2$^{nd}$ press on the button T has been detected by the absence, from the time t3, of fine zero resetting pulses in the signal Vs applied to its input E1. As the button T short-circuits the power transistor T1 up to time t4, the voltage Vs nevertheless remains at its maximum value Vsmax=Vb up to time t4 and can only switch to the value Vsmean at time t4, when the button T is released.

In the example represented, the button is no longer actuated up to time t5. During the period t4-t5, the signals A2 and Vs therefore remain unchanged and the processing circuit 3 considers that no new press has been exerted on the button T due to the constant presence of the fine zero resetting pulses in the signal Vs.

When the button T is pressed again, at time t5, the voltage Vs automatically reverts to the value Vb until the button is released at time t6. During the period t5-t6, the turn-off pulses are no longer transmitted to the voltage Vs. The electronic processing circuit 3 can consequently rapidly detect this new press on the button and modify the control signal A2 to take account of this new press. In the example represented in FIG. 9, the period t4-t5 being more than 2 s, the electronic processing circuit sets the signal A2 to zero as soon as this new press is detected (between times t5 and t6) to turn the power transistor T1 off and thus switch off the lamp as soon as the button is released, at time t6.

Figure 10:
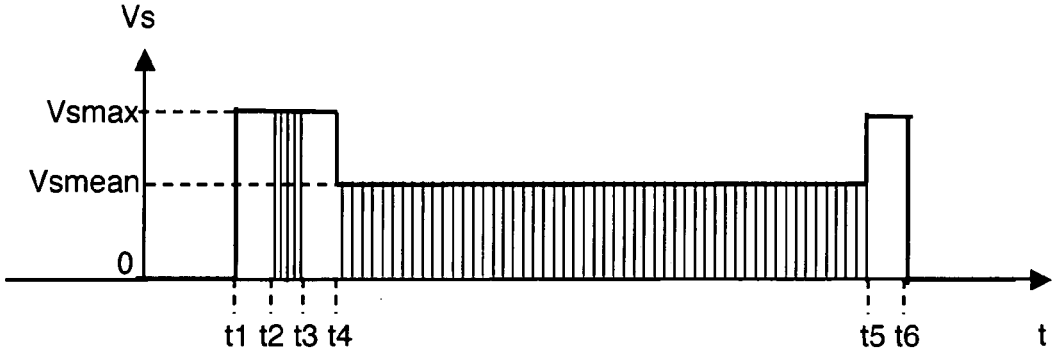

In an alternative embodiment, a limiting resistor R (represented by a broken line in FIG. 5) is connected in series with the button T in the 1$^{st}$ branch of the power switch. This limits flash effects due to the button T being pressed, when switching from one operating mode to another. Indeed, as illustrated in FIG. 10 between times t5 and t6, in the absence of this resistor R, any press on the button T automatically applies the voltage Vb to the terminals of the light-emitting diode. Inserting the limiting resistor R on the other hand enables the current flowing through the button, and consequently the power in the light-emitting diode, to be limited when the button T is pressed. The value of the limiting resistor R is for example chosen such that the power transmitted to the light-emitting diode by the button T corresponds to the minimum power of the lamp.

The processing circuit 3 of FIGS. 5 and 6 can therefore reconstitute the state of the button and detect all the presses, determine the number of times the button is pressed, for how long (short press, long press), and the durations of the time intervals between presses to control operation of the lamp accordingly.

Connecting the control button T in parallel with the power transistor and periodic turn-off of the power transistor T1, by fine pulses, thus enhances the dependability of the lamp in the event of failure of an electronic component, while enabling the lamp to be controlled according to the number of presses and/or the pressing time and/or the time interval between presses on the control button, which remains the sole interface with the user. In the event of failure of one of the electronic components of the lamp, the user can still use the lamp, for example at its maximum power, by pressing on the button T.

The processing circuit 3 can provide the fine turn-off pulses continuously or only after a first press has been detected (when switching from Vs to Vb).

The invention claimed is:

1. Electric lamp comprising:

at least one light-emitting diode and an electronic power switch connected in series between a power source and the light-emitting diode and controlled by an electronic processing circuit according to a state of a control switch connected to a control input of the electronic processing circuit, wherein the control switch is connected in parallel to the electronic power switch between the power source and a point common to the electronic power switch and to the light-emitting diode, and the electronic processing circuit comprises state of the control switch detecting means periodically applying fine turn-off pulses to a control electrode of the electronic power switch.

2. Lamp according to claim 1, wherein a limiting resistor is connected in series with the control switch.

3. Lamp according to claim 1, wherein the electronic power switch and the electronic control circuit are located in a single electronic chip.

4. Lamp according to claim 3, wherein the chip comprises first and second power supply terminals connected to terminals of the power source and an input/output connected to the light-emitting diode.

5. Lamp according to claim 1, wherein the control switch is formed by a button.

6. Lamp according to claim 5, wherein the electronic processing circuit controls the lamp according to a number of successive presses on the button.

7. Lamp according to claim 5, wherein the electronic processing circuit controls the lamp according to a time during which the button is kept depressed.

8. Lamp according to claim 5, wherein the electronic processing circuit controls the lamp according to a duration of a time interval between two presses on the button.

* * * * *